US007288053B2

(12) United States Patent
Endelman et al.

(10) Patent No.: US 7,288,053 B2
(45) **Date of Patent: *Oct. 30, 2007**

(54) REFORMER EXERCISE APPARATUS ANCHOR BAR AND CARRIAGE STOP/ASSEMBLY

(75) Inventors: Ken Endelman, Sacramento, CA (US); Edward D. Barnard, Roseville, CA (US)

(73) Assignee: Balanced Body, Inc., Sacramento, CA (US)

( * ) Notice: Subject to any disclaimer, the term of this patent is extended or adjusted under 35 U.S.C. 154(b) by 381 days.

This patent is subject to a terminal disclaimer.

(21) Appl. No.: 10/920,741

(22) Filed: Aug. 17, 2004

(65) Prior Publication Data

US 2005/0113227 A1 May 26, 2005

Related U.S. Application Data

(63) Continuation-in-part of application No. 10/723,407, filed on Nov. 25, 2003, now Pat. No. 7,163,500.

(51) Int. Cl.
*A63B 26/00* (2006.01)

(52) U.S. Cl. ..... 482/142; 482/121

(58) Field of Classification Search ..... 482/148, 482/121, 142

See application file for complete search history.

(56) References Cited

U.S. PATENT DOCUMENTS 339,638 A 4/1886 Goldie
1,621,477 A 3/1927 Pilates
1,738,987 A 12/1929 Dattilo
1,750,549 A 3/1930 Thomson et al.
1,979,783 A 11/1934 Williams et al.
1,980,036 A 11/1934 Casler et al.
2,733,922 A 2/1956 Diego
3,261,606 A 7/1966 Elia et al.
3,586,322 A 6/1971 Kverneland
3,770,267 A 11/1973 McCarthy
3,892,404 A 7/1975 Martucci (Continued)

OTHER PUBLICATIONS

Stott Equipment Advertisements.

*Primary Examiner*—Lori Amerson
(74) *Attorney, Agent, or Firm*—Greenberg Traurig LLP; John R. Wahl, Esq.

(57) ABSTRACT

A reformer exercise apparatus has a head end and a foot end and a pair of spaced apart parallel track members, a movable carriage mounted on the track members for movement between the head and foot end. One or more springs are connected between the carriage and an elastic member anchor bar and carriage stop assembly at the foot end. The anchor bar and carriage stop assembly adjustably positions the carriage, the anchor bar and the elastic members on the tracks to accommodate a wide range of user heights. Each end of the anchor bar is disposed in an elongated slot formed in each track member. The elongated slot has spaced gear teeth shaped openings defining spaced anchor bar stop or lock portions. The anchor bar can be moved between lock portions only when rotated to an unlocked position wherein the bar, coupled to the carriage, can slide along the track within the slot. In addition, the assembly maintains the carriage and anchor bar a predetermined distance apart when the anchor bar is in the unlocked position and maintains a minimum distance between the anchor bar and the carriage when the anchor bar is in the locked position.

35 Claims, 14 Drawing Sheets

U.S. PATENT DOCUMENTS

| | | | | |
|---|---|---|---|---|
| 4,084,815 | A | 4/1978 | Flannery | |
| 4,272,074 | A | 6/1981 | Sferle | |
| 4,290,600 | A | 9/1981 | Kolbel | 272/137 |
| 4,357,010 | A | 11/1982 | Telle | 272/117 |
| 4,376,533 | A | 3/1983 | Kolbel | 272/137 |
| 4,383,684 | A | 5/1983 | Schliep | |
| 4,517,966 | A | 5/1985 | von Othegraven | 128/75 |
| 4,700,945 | A | 10/1987 | Rader | |
| 4,706,953 | A | 11/1987 | Graham | |
| 4,709,918 | A | 12/1987 | Grinblat | 272/97 |
| 4,768,776 | A | 9/1988 | Giannotti | |
| 4,775,150 | A | 10/1988 | Graham | 272/143 |
| 4,776,583 | A | 10/1988 | Jennings | 272/73 |
| 4,884,802 | A | 12/1989 | Graham | |
| 4,911,438 | A | 3/1990 | Van Straaten | |
| 4,974,832 | A | 12/1990 | Dalebout | |
| 5,014,966 | A | 5/1991 | Wang | 267/64 |
| 5,024,214 | A | 6/1991 | Hayes | |
| 5,066,005 | A | 11/1991 | Luecke | |
| 5,207,628 | A | 5/1993 | Graham | 482/140 |
| 5,263,913 | A | 11/1993 | Boren | |
| 5,338,278 | A | 8/1994 | Endelman | |
| 5,352,169 | A | 10/1994 | Eschenbach | 482/57 |
| 5,364,327 | A | 11/1994 | Graham | |
| D354,780 | S | 1/1995 | Endelman | |
| D354,781 | S | 1/1995 | Endelman | |
| 5,423,729 | A | 6/1995 | Eschenbach | 482/70 |
| D362,700 | S | 9/1995 | Breibart et al. | |
| 5,529,554 | A | 6/1996 | Eschenbach | 482/57 |
| 5,580,340 | A | 12/1996 | Yu | 482/96 |
| 5,607,381 | A | 3/1997 | Endelman | |
| 5,653,670 | A | 8/1997 | Endelman | |
| 5,681,249 | A | 10/1997 | Endelman | |
| 5,792,033 | A | 8/1998 | Merrithew | 482/96 |
| 5,795,271 | A | 8/1998 | Pearson | 482/72 |
| 5,807,217 | A | 9/1998 | Endelman | |
| 5,816,981 | A | 10/1998 | Hung | 482/54 |
| 5,853,357 | A | 12/1998 | Jones, Jr. | 482/140 |
| 6,120,425 | A | 9/2000 | Endelman et al. | |
| 6,179,759 | B1 | 1/2001 | Tellone | 482/111 |
| 6,186,929 | B1 | 2/2001 | Endelman et al. | 482/121 |
| 6,206,530 | B1 | 3/2001 | Eberts | 359/879 |
| 6,971,976 | B2 * | 12/2005 | Endelman et al. | 482/121 |
| 7,125,369 | B2 * | 10/2006 | Endelman | 482/142 |
| 2003/0119636 | A1 | 6/2003 | Endelman | |

* cited by examiner

REFORMER EXERCISE APPARATUS ANCHOR BAR AND CARRIAGE STOP/ASSEMBLY

CROSS REFERENCE TO RELATED APPLICATIONS

This application is a continuation-in-part of U.S. patent application Ser. No. 10/723,407, filed Nov. 25, 2003 now U.S. Pat. No. 7,163,500.

BACKGROUND OF THE INVENTION

1. Field of the Invention

This invention relates generally to the field of exercise equipment in which a movable carriage is utilized to at least partially support a user's body, commonly referred to as a "reformer", and more particularly to a reformer having an adjustable spring anchor bar and carriage stop assembly.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U.S. Pat. No. 5,066,005 and my patents referred to above are representative of the current state of evolutionary development of these changes that have taken place since 1927.

The current conventional apparatus is commonly referred to as a "reformer" which includes a wheeled platform carriage which rides on a parallel rails on or forming part of a rectangular wooden or metal frame. The carriage is connected to a series of parallel springs or elastic members which are in turn connected to a foot end of the rectangular frame. The carriage rides on the rails or on tracks mounted to the inside of the longer sides of the rectangular frame. This carriage typically includes a pair of spaced, padded, upright shoulder stops and a head rest at one end to support the shoulders and head of the user when he/she is reclined on the carriage. An adjustable foot bar, foot support, or foot rest against which the user places his/her feet is removably mounted to the foot end of the rectangular frame. A spring support rod is positioned across the foot end between the tracks by a spring support bracket fastened to the frame. The rod typically fits in one of three or four recesses or slots in the support bracket, depending on the size or ability of the user. Alternatively, the spring support rod may be permanently fastened to the frame. The user can then push against the foot rest to move the carriage along the track away from the foot rest against spring tension to exercise the leg and foot muscle groups in accordance with prescribed movement routines. Ropes connected to the head end of the carriage via pulleys at the head end of the frame are used to exercise the user's arm and torso muscle groups.

The carriage is prevented from moving close to the foot rest by a stop pin fastened to the top of each track, against which the carriage abuts when the carriage is at rest. Alternatively, the stop pin function may be performed by a spring anchor bar and carriage stop member such as is disclosed in my U.S. Pat. Nos. 6,120,425 and 6,338,704.

Many conventional reformer designs utilize a tubular anchor bar that slips into slanted slots in a bracket fastened to the rails at the foot end of the frame. The slots permit a user to adjust the longitudinal position of the anchor along the rails. This anchor bar is typically round in cross section. Thus, when a user decides to change the number of springs attached to the anchor bar, he or she must be careful not to remove all of the springs from the anchor bar at the same time, because without some spring tension on at least one hook, the anchor bar will simply rotate downward, positioning the hooks toward the floor. Then the user must use one hand to rotate the bar so that the hooks face the carriage, and use her other hand to fasten a spring onto one of the hooks. Another drawback with the conventional round bar and slotted bracket spring anchor design is that the brackets are separate components which must typically be installed at the foot end of the frame over the rails.

SUMMARY OF THE INVENTION

An embodiment of the present invention may be viewed as a reformer exercise apparatus that preferably includes a wheeled carriage having a generally flat top surface. The carriage is movably mounted on parallel track members attached to or forming sides of a generally rectangular frame which has a head end and a foot end. The carriage has a pair of shoulder stops mounted thereto and a head rest between the shoulder stops that extends outward from the carriage toward the head end of the frame. A plurality of elastic members connected between the foot end and the carriage elastically bias the carriage toward the foot end of the frame. A movable spring anchor bar and carriage stop assembly is incorporated into and between the track members at or adjacent the foot end of the rectangular frame to anchor the elastic members and position the carriage appropriately in relation to the anchor bar.

The track members are preferably tubes, each having preferably a rectangular cross section, that extend between the head end and the foot end of the frame. Alternatively, each of the track members could have a "top hat" or U shaped cross section such that, when fastened to the inside of the sides of the frame, the track has a horizontal track surface for the carriage support rollers and a vertical side wall for the carriage guide rollers to ride against. The spring anchor bar and carriage stop assembly in accordance with an embodiment of the present invention involves the carriage, the tubular track members and an elongated anchor bar having opposite ends that ride in elongated slots in facing vertical side walls of the tubular track members. More specifically, each track member has an elongated longitudinal keyway slot formed adjacent the foot end of the track member in the inside wall of the track member. Each keyway slot has a series of spaced gear teeth cutouts that form spaced anchor bar stop portions. Each end of the anchor bar forms a key or tenon that rides within one of the elongated keyways such that the anchor bar is carried by and captured between the spaced apart track members by the keyed ends of the anchor bar.

When the anchor bar is captured in these slots, the anchor bar may be rotated about its longitudinal axis between a locked position against the walls of a pair of the teeth and an unlocked position with the tenons parallel to the length of the slot. These teeth or stop portions are shaped to permit rotation of the keyed end of the anchor bar between the locked and unlocked positions when both ends are aligned in corresponding stop portions. Between these stop portions, i.e., when the keyed ends are aligned parallel to the length of the elongated keyway slots, the anchor bar keyed ends slide so that a user can move the anchor bar back and forth toward and away from the foot end of the frame between the sequential stop portions of the keyway slots.

One preferred embodiment of the invention includes a carriage stop bracket extending from the anchor bar toward the carriage that rotates with the anchor bar to lock the anchor bar and carriage together when the anchor bar is in the unlocked position. This same stop bracket maintains the carriage at a predetermined minimum distance from the anchor bar, and unlocks the carriage when the anchor bar is rotated to the locked position.

Another embodiment of the present invention is incorporated into a reformer exercise apparatus in which the footbar may be positioned at either the head end or the foot end of the frame as well as various points in between via a support bracket assembly which slides in a T-slot along each of the frame sides and includes both horizontal and vertical foot bar positions along with various angular positions permitting the foot bar to be selectively positioned in a plurality of vertical positions from the carriage and near either the head or the foot end of the frame.

Other objects, features and advantages of the present invention will become apparent from a reading of the following detailed description when taken in conjunction with the accompanying drawing wherein particular embodiments of the invention are disclosed as illustrative examples.

DETAILED DESCRIPTION OF THE INVENTION

Figure 1:
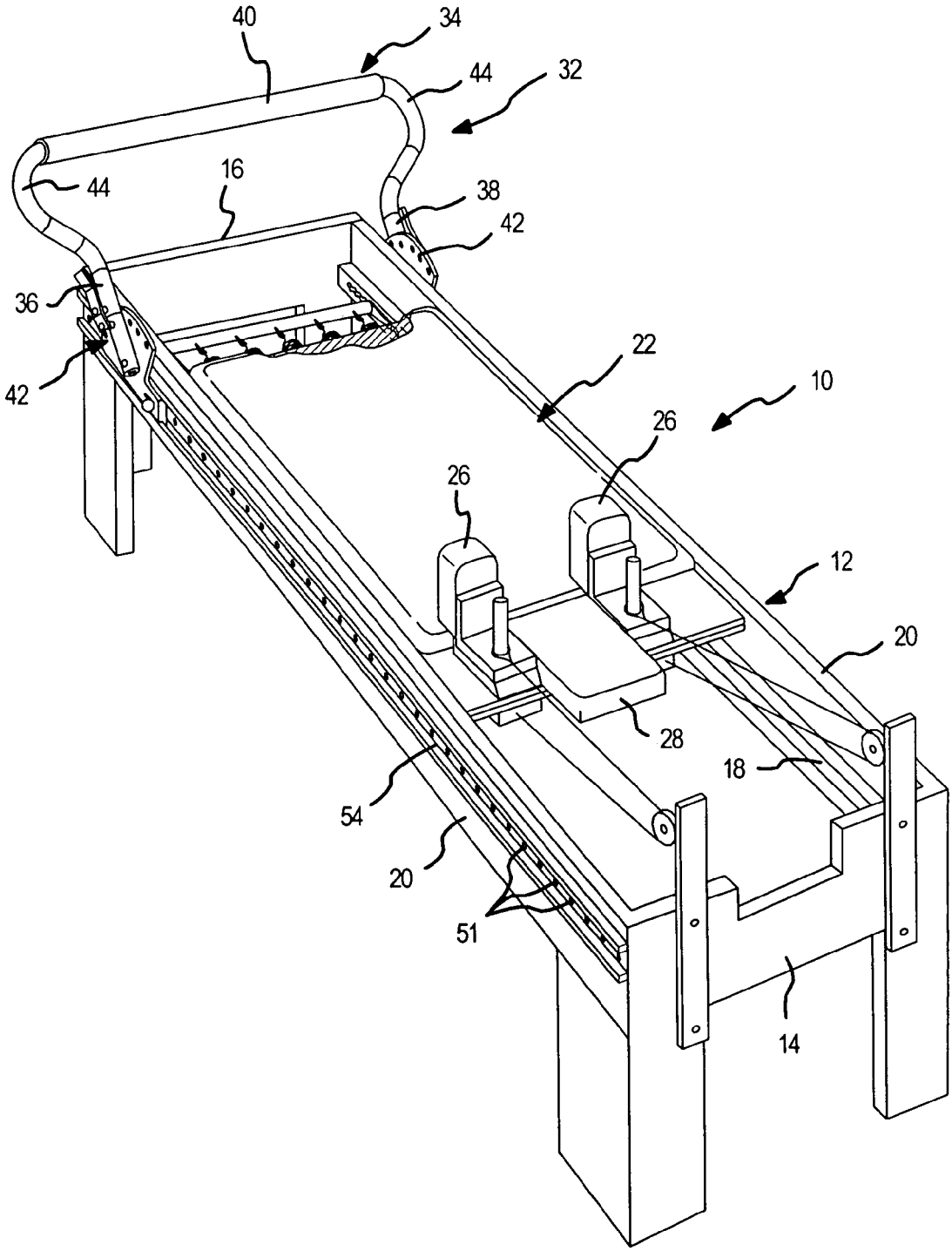
FIG. 1 is a perspective view of a reformer exercise apparatus in accordance with embodiments of the present invention with portions of the carriage in the retracted position against the carriage stops of the anchor bar and carriage stop assembly.

An exercise apparatus 10 in accordance with one embodiment of the present invention is shown in FIG. 1. Exercise apparatus 10 comprises a generally rectangular frame 12 having a head end 14 and a foot end 16 and a pair of parallel track or rail members 18. The frame 12 may be a generally rectangular wood frame with the track or rail members 18 fastened to the insides of opposite side walls 20 of the frame 12, or the rail members 18 themselves may constitute the parallel side walls of the frame 12, as in a reformer having a metal tubular frame. The apparatus 10 further comprises a movable carriage 22 slidably or rollably disposed on the track members 18 for movement back and forth on the track members 18 between the head and foot ends 14 and 16 respectively.

Each of the track members 18 in the reformer apparatus 10 in accordance with the present invention is a metal tube that has a rectangular, and preferably a generally square cross-sectional shape. These metal tubes are, in the embodiment illustrated, bolted or otherwise fastened to the inside surfaces of the side walls 20 of the frame 12.

The carriage 22 includes a generally flat padded platform 24 for supporting a user's body and has a pair of spaced apart shoulder stops 26 fastened to the upper surface of the platform 24 adjacent the head end of the carriage 22 and a head rest 28 centered between the shoulder stops 26. The head rest 28 may be hinged to the platform 24 such that it may be adjusted between at least a raised and a lowered position. The head rest extends outward from the platform 24 toward the head end of the frame 12. Preferably the carriage 22 has four support wheels or rollers (not shown) which support the carriage 22 on the horizontal top surface of the track members 18 for movement back and forth on the track members 18 with minimal friction. The carriage 22 also has 4 guide rollers 25 (FIG. 5) beneath the platform 24 adjacent the support rollers that roll along the vertical surface of the track members 18 to prevent binding of the carriage 22 on the track members 18 or against the frame side walls 20. The guide and support rollers are mounted to a square tubular member 27 fastened to the underside of the platform 24. A plurality of elastic resistance members 30, typically springs as shown in the Figures, are hooked to or otherwise fastened between the foot end of the carriage 22 and the foot end 14 of the frame 12 such that the carriage 22 is biased toward the foot end of the frame 12.

The foot bar assembly 32 comprises a generally U shaped foot bar 34, preferably made of tubular aluminum, having a pair of spaced parallel leg portions 36 and 38 and a foot bar portion 40 therebetween and a pair of adjustable support bracket assemblies 42. A padded sleeve over the foot bar portion 40 provides a cushion support for a user's foot. The foot bar support bracket assembly 42 is separately shown in perspective separated from the frame 12 in FIG. 3.

Figure 3:
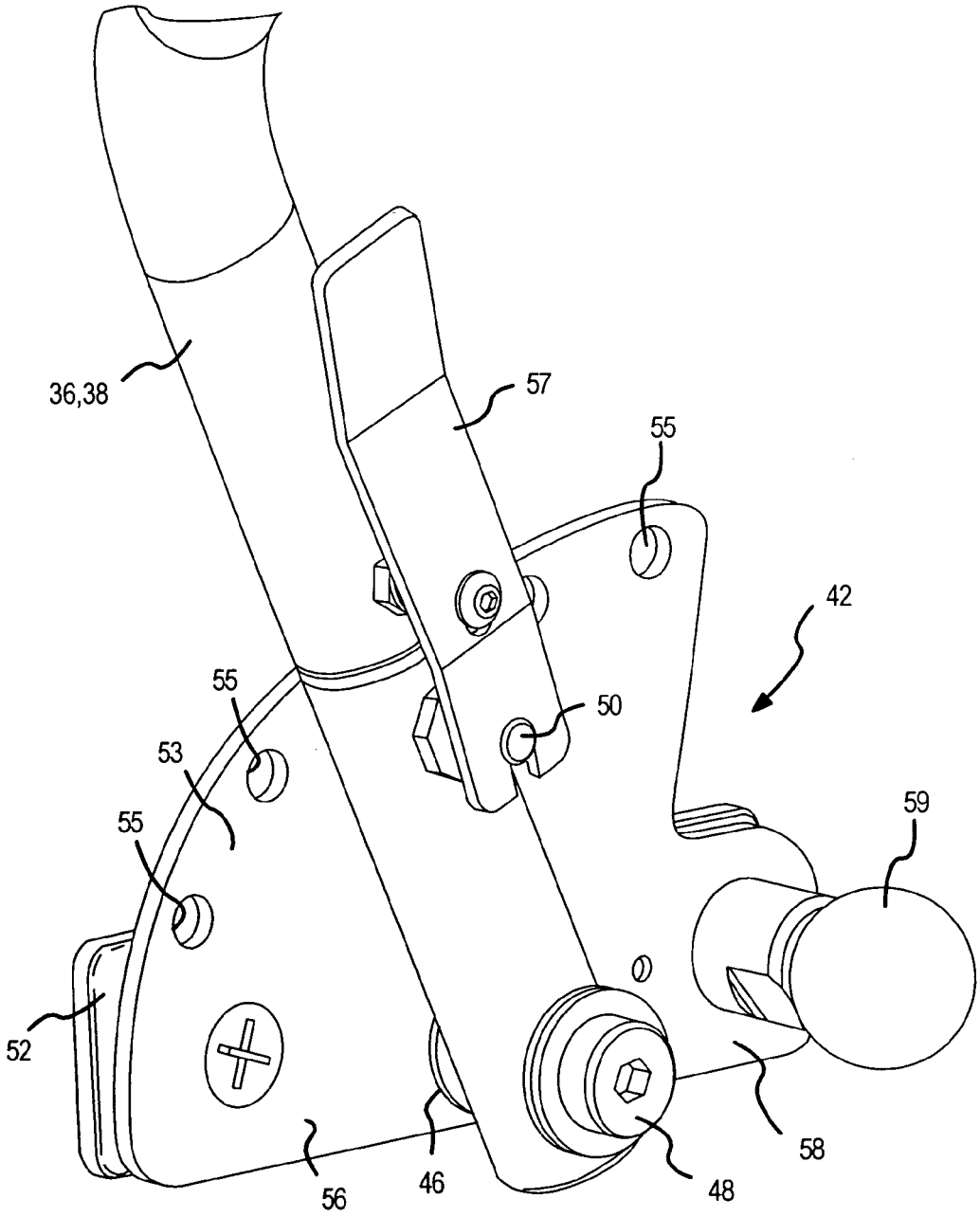
FIG. 3 is a separate perspective view of the foot bar support assembly shown in FIGS. 1 and 2.

The foot bar portion 40 has a generally S shaped recurve region 44 at each end thereof joining the leg portions 36 and 38 so that the straight portion of the foot bar portion 40 extends fully across the rail members 18 and, when the foot bar 34 is rotated so as to lie horizontally over the foot end 16, the bar 34 clears the end 16. The recurve region 44 further provides a more rigid structure to the foot bar 34 than a simple straight right angle bend between the leg and foot bar portions and provides clearance for a user's ankles when the users feet are spaced apart on the bar 34. Referring now to FIG. 3, at each distal end of the leg portions 36 and 38 is a transverse bearing sleeve 46. A pivot pin 48 is fastened through the sleeve 46 into a threaded central bore in one of the support brackets 42. A spring loaded stop pin 50 is fitted through a corresponding bore through each of the leg portions 36 and 38 spaced above the pivot sleeve 46. This stop pin 50 is used to adjust the vertical position of the foot bar portion 40 of the bar 34 as more fully described below.

Each of the support bracket assemblies 42 comprises an elongated support bar 52 having a generally T shaped cross section sized complementary to a T-slot 54 mounted along the length of the frame side wall 20 so that the support bar 52 can slide back and forth in the T-slot 54 between the foot end 16 and the head end 14. Fastened to the base of the T shaped cross section of the support bar 52 is a support plate 56 having an elongated base portion 58 extending along the base of the support bar 52 and an arcuate portion 53 extending parallel to the top of the support bar 52. This arcuate portion 53 has a series of holes 55 spaced at different angles from the horizontal plane through the central pivot pin 48. The holes 55 are positioned to receive the spring loaded stop pin 50 to lock the position of the foot bar 34 at a particular desired height above the rail members 18. At least one of the holes 55 is directly above the pivot pin 48 providing a vertical position of the foot bar 34. Another of the holes 55 is horizontally aligned with the central pivot pin 48 to completely collapse the foot bar 34 around the foot end 16 of the frame 12. The stop pin 50 is activated by depressing a lever 57 that pivots to lift the spring biased stop pin 50 out of one of the holes 55 to permit the foot bar 34 to be rotated to a desired position. This configuration permits the foot bar 34 to be positioned below the top of the reformer so that the entire upper surface of the reformer 10 may be utilized without the foot bar 34.

At the other end of the base portion 58 of the support plate 56 is a spring loaded stop pin assembly 59. The pin of the stop pin assembly 59 selectively fits into one of a plurality of horizontally spaced apart holes 51 in the T slot 54. The support bar 52 of the foot bar assembly 32 slides along in the T-slot 54. The spring loaded stop pin assembly 59 stops the support bar 52, and thus the foot bar assembly 32, at a desired position along the frame wall 20. This configuration, with the T slot 54 extending the entire length of the frame 12, facilitates a variety of new exercise possibilities that were heretofore impossible with a foot bar 34 positionable only adjacent a foot end of the frame of the reformer 10.

Figure 2:
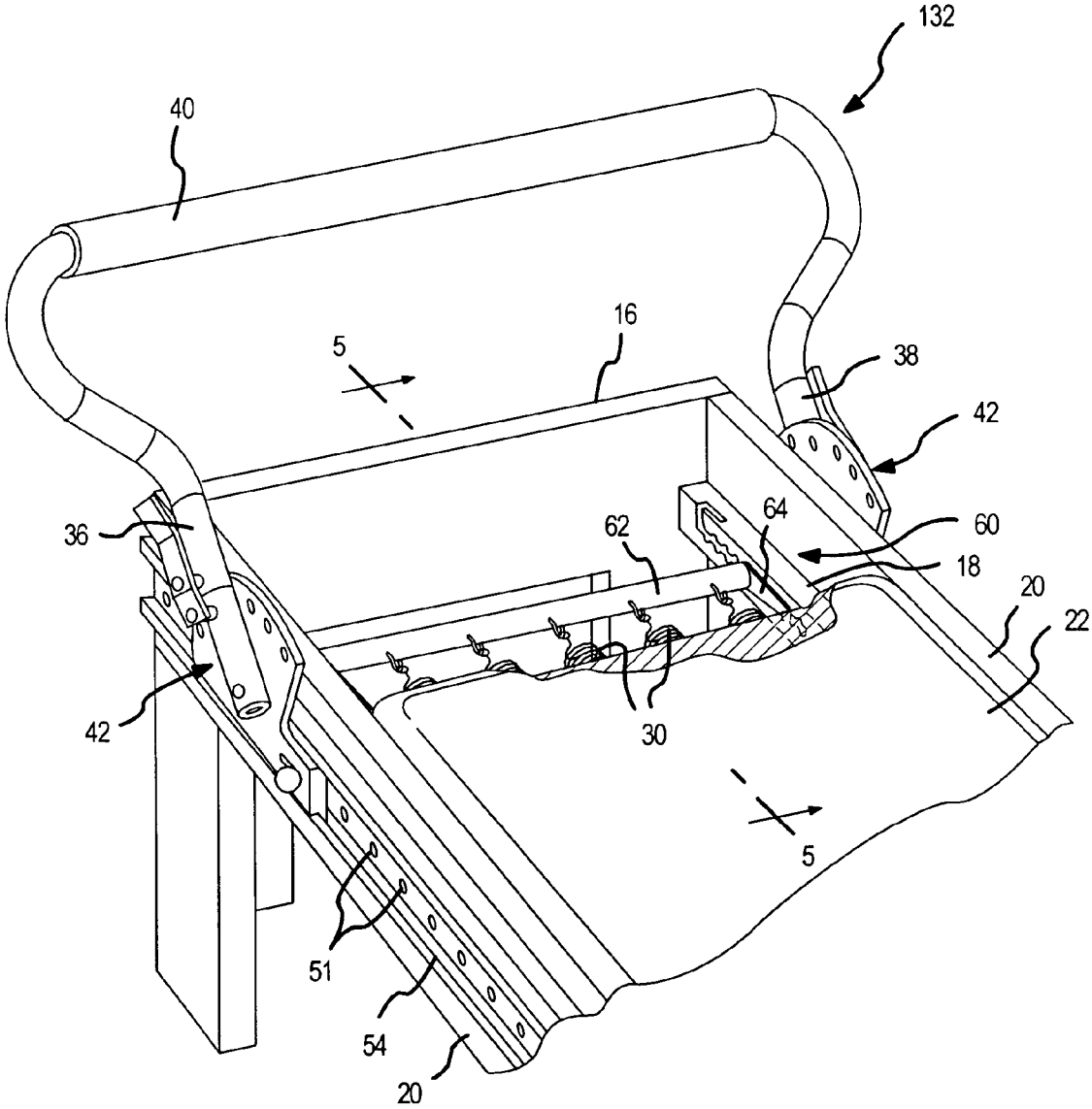
FIG. 2 is a partial enlarged perspective view of the foot end of the reformer shown in FIG. 1.

The reformer 10 incorporating embodiments of the present invention is shown in more detail in FIG. 2. The springs 30 are attached to an anchor bar and carriage stop assembly 60 incorporated with the tracks 18 at the foot end 16. The anchor bar and carriage stop assembly 60 adjustably anchors the springs 30 to an anchor bar 62 at the foot end 16 of the frame 12 and maintains a predetermined minimum distance between the carriage 22 and the anchor bar 62 via at least one carriage stop member 64 attached to the anchor bar 62. The anchor bar 62 is an elongated straight bar or tube that may have a circular cross section. Alternatively, bar 62 may have a C shaped cross section or other elongated closed or open shape.

Figure 6:
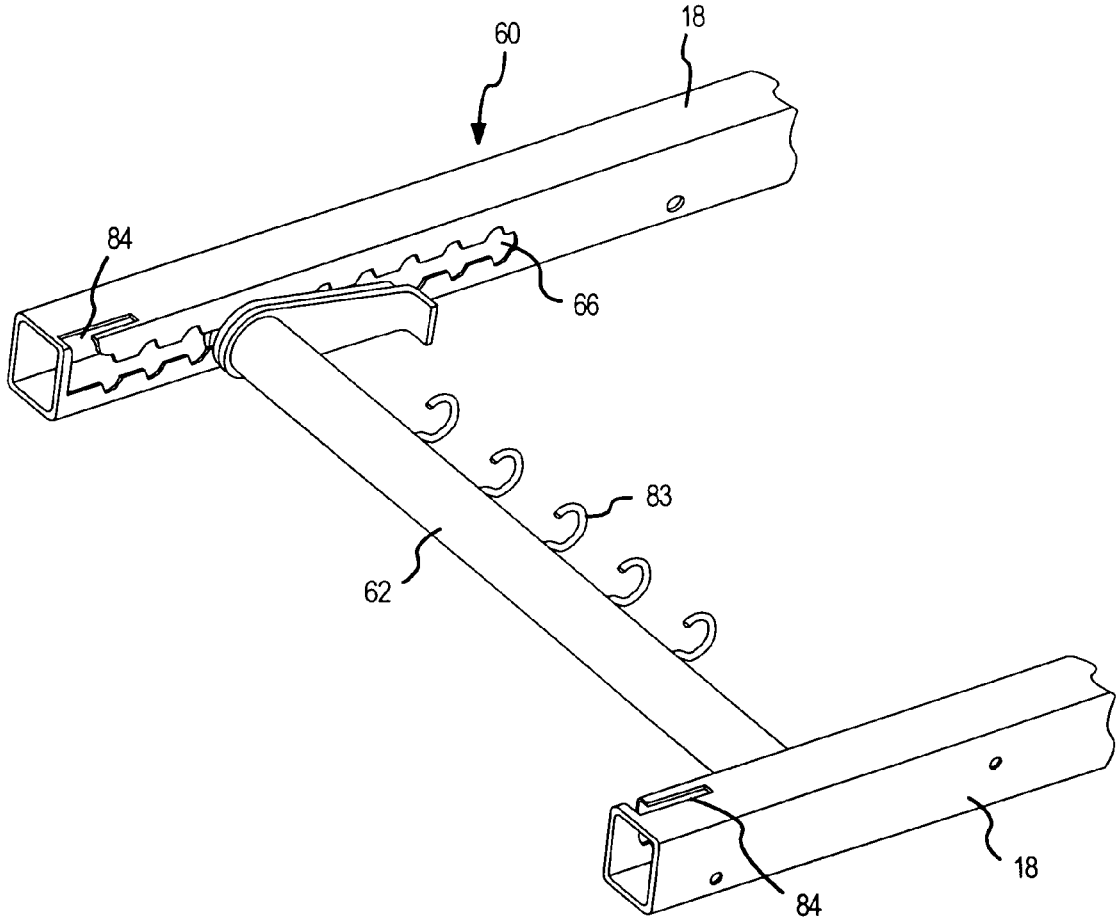
FIG. 6 is a separate perspective view of the anchor bar and carriage stop assembly in accordance with an embodiment of the present invention.
Figure 7:
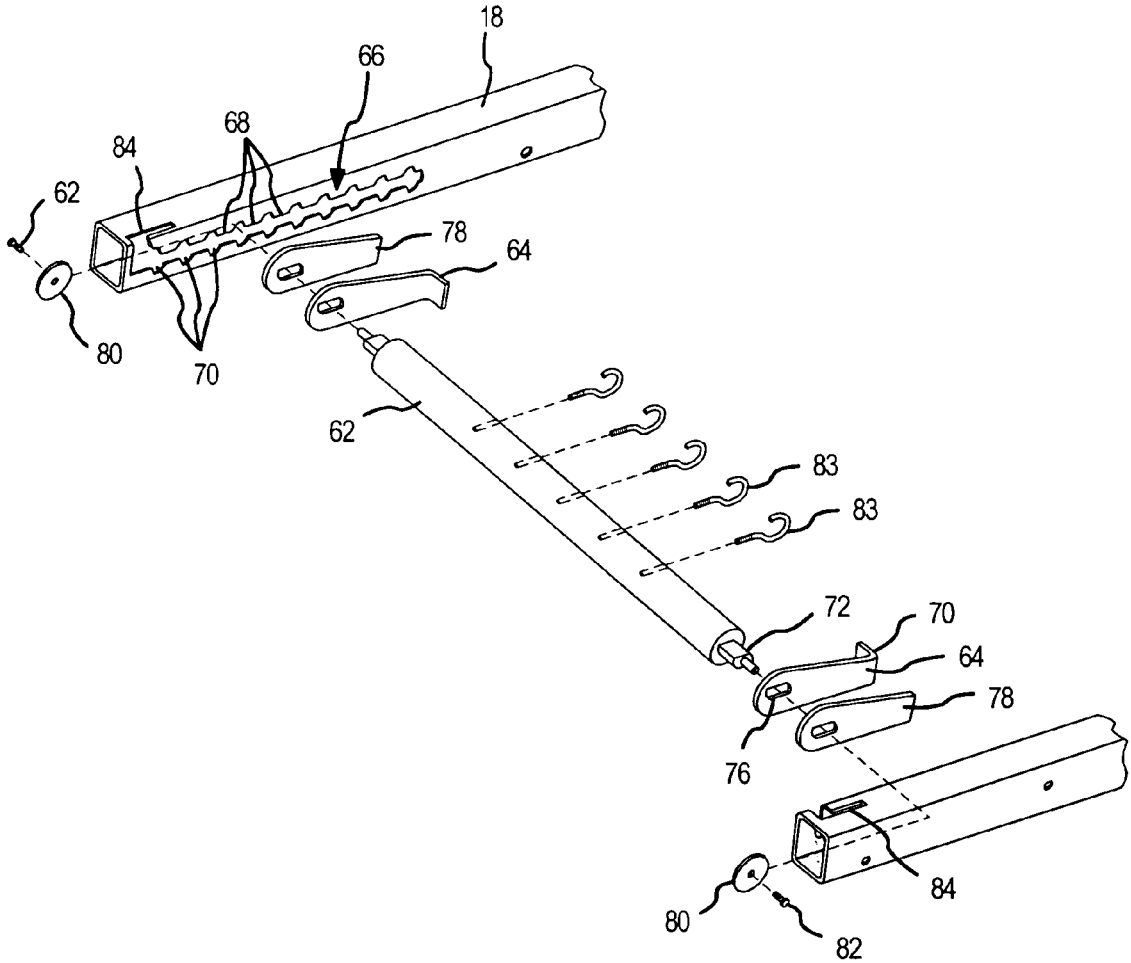
FIG. 7 is an exploded perspective view of the anchor bar and carriage stop assembly shown in FIG. 6.
Figure 8:
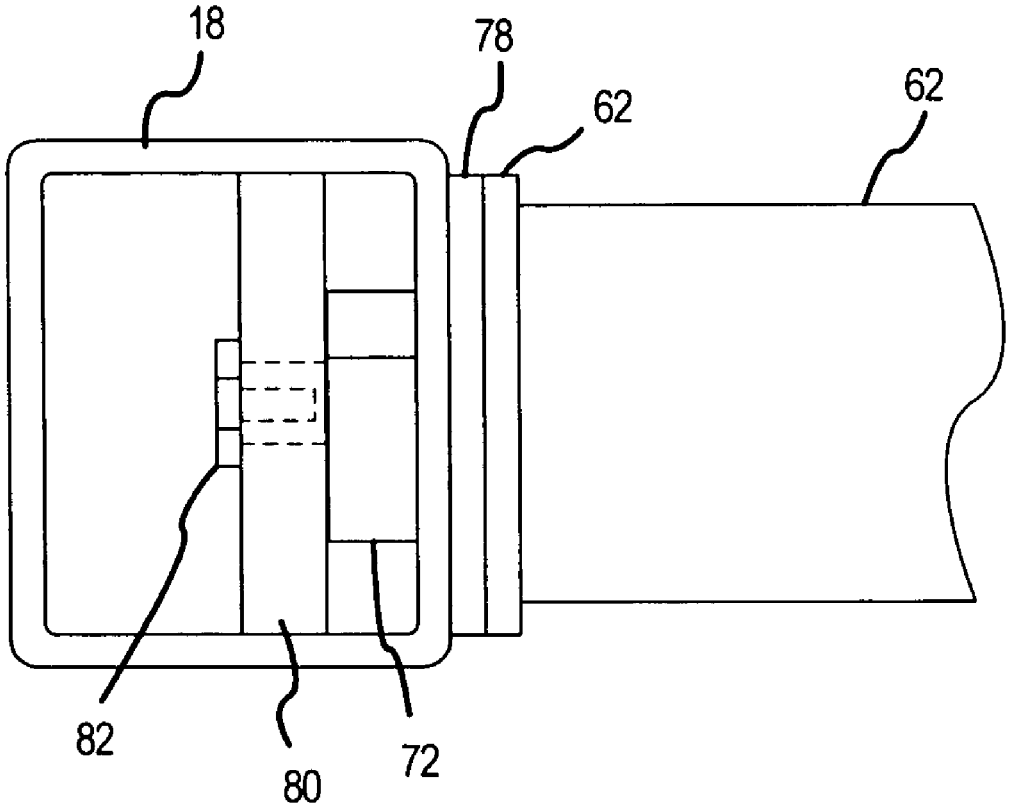
FIG. 8 is an end view of one side of the assembly shown in FIG. 6.

The anchor bar and carriage stop assembly 60 in accordance with an embodiment of the invention is separately shown in FIGS. 6, 7, and 8. The assembly 60 includes the pair of spaced track members 18 and the anchor bar 62. The anchor bar 62 has an elongated carriage stop arm 64 adjacent each end of the anchor bar 62. In the locked position, as will be explained in more detail below with reference to FIG. 4, the distal end of the stop arm 64 abuts against the carriage 22 to maintain a predetermined minimum distance between the anchor bar 62 and the carriage 22. This stop arm 64 also acts as a lever to rotate the anchor bar from the locked position to the unlocked position to permit the anchor bar 62 to be repositioned along the slot 66.

Each of the track members 18 has an elongated keyway slot 66 formed in the inside wall of the tubular track member 18 adjacent the foot end 16 of the frame 12. The portion of each track member 18 forming the keyway slot 66 includes a plurality of spaced gear teeth 68 defining anchor bar stop or lock portions 70. Each end of the anchor bar 62 includes a generally rectangular tenon 72 projecting axially as well as a projecting axle pin 74 extending from the distal end of the tenon 72. As is best seen in FIG. 7, the proximal end of the stop arm 64 has an elongated generally rectangular slot 76 complementary in shape to the tenon 72 to receive the tenon 72 therethrough such that the stop arm 64 is held against the base of the tenon 72 and cannot rotate about the anchor bar 62. An elongated spacer arm 78 similarly has a slot sized to fit the spacer onto the tenon 72. A guide wheel 80 is fastened onto the axle 74 with a screw 82.

As can be seen in FIG. 7, the stop arms 64 are assembled onto the tenons 72, the spacers installed next onto the tenons 72, and a guide wheel 80 is fastened to each of the axles 74. Finally, a series of spring anchor hooks 83 are installed onto the anchor bar. The wheels 80 of this subassembly are then dropped into the slots 84 in the top wall of the track members 18 that join with the slots 66 so that the tenons 72 on the anchor bar 62 fit into the slots 66 to complete the assembly of the anchor bar and carriage stop assembly 60. In this configuration, the guide wheels 80 ride between the top and bottom walls within the track members 18 to ensure that the tenons 72 are substantially centered in the slots 66 so that the anchor bar 62 will not bind in the track members 18 or slots 66. This can best be seen in the end view of FIG. 8.

Figure 4:
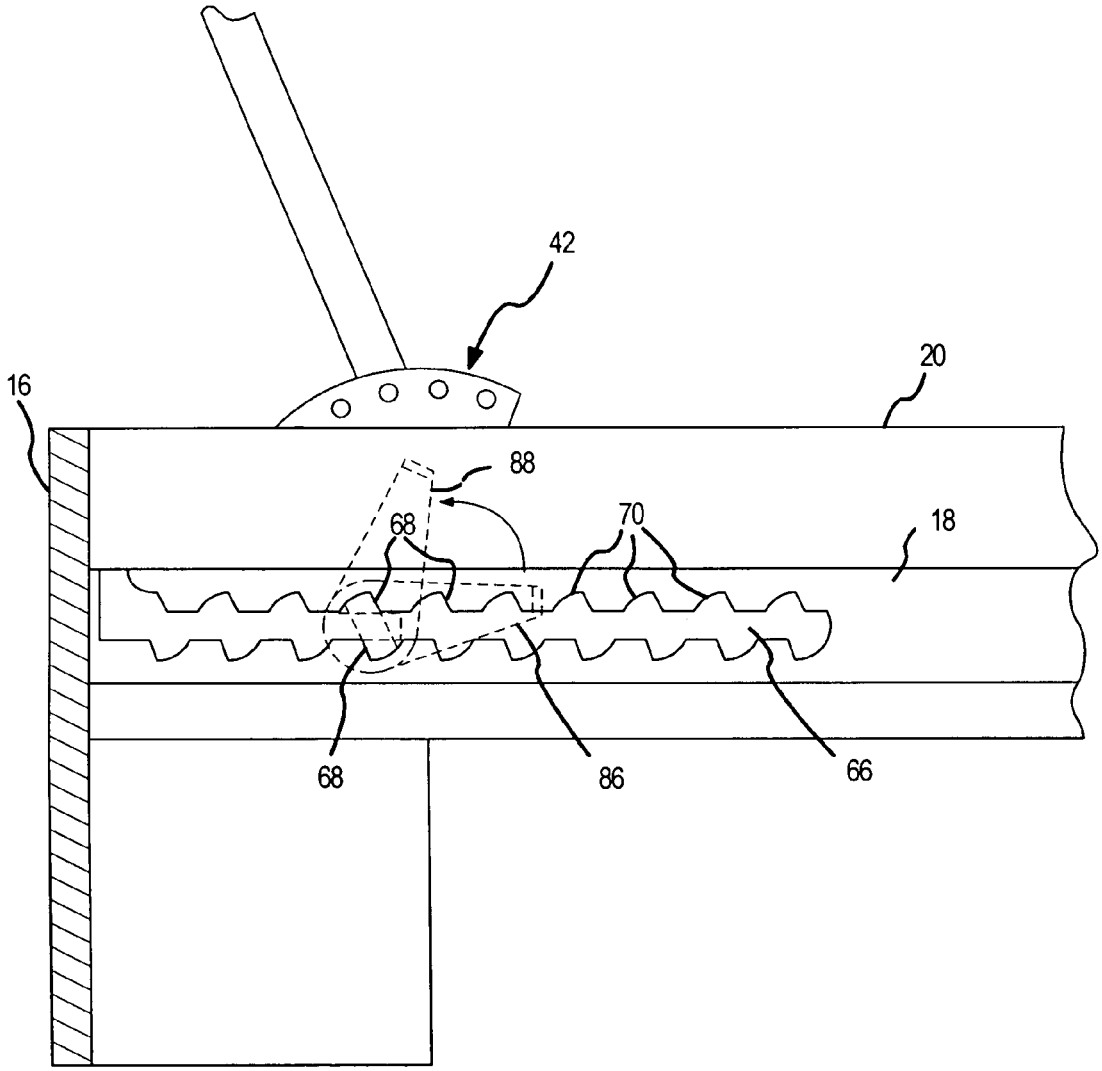
FIG. 4 is a partial view of the reformer from inside the foot end of the reformer shown in FIG. 1 with the right side of the frame removed illustrating the anchor bar in the locked position in dashed lines and in the unlocked position in dotted lines.
Figure 5:
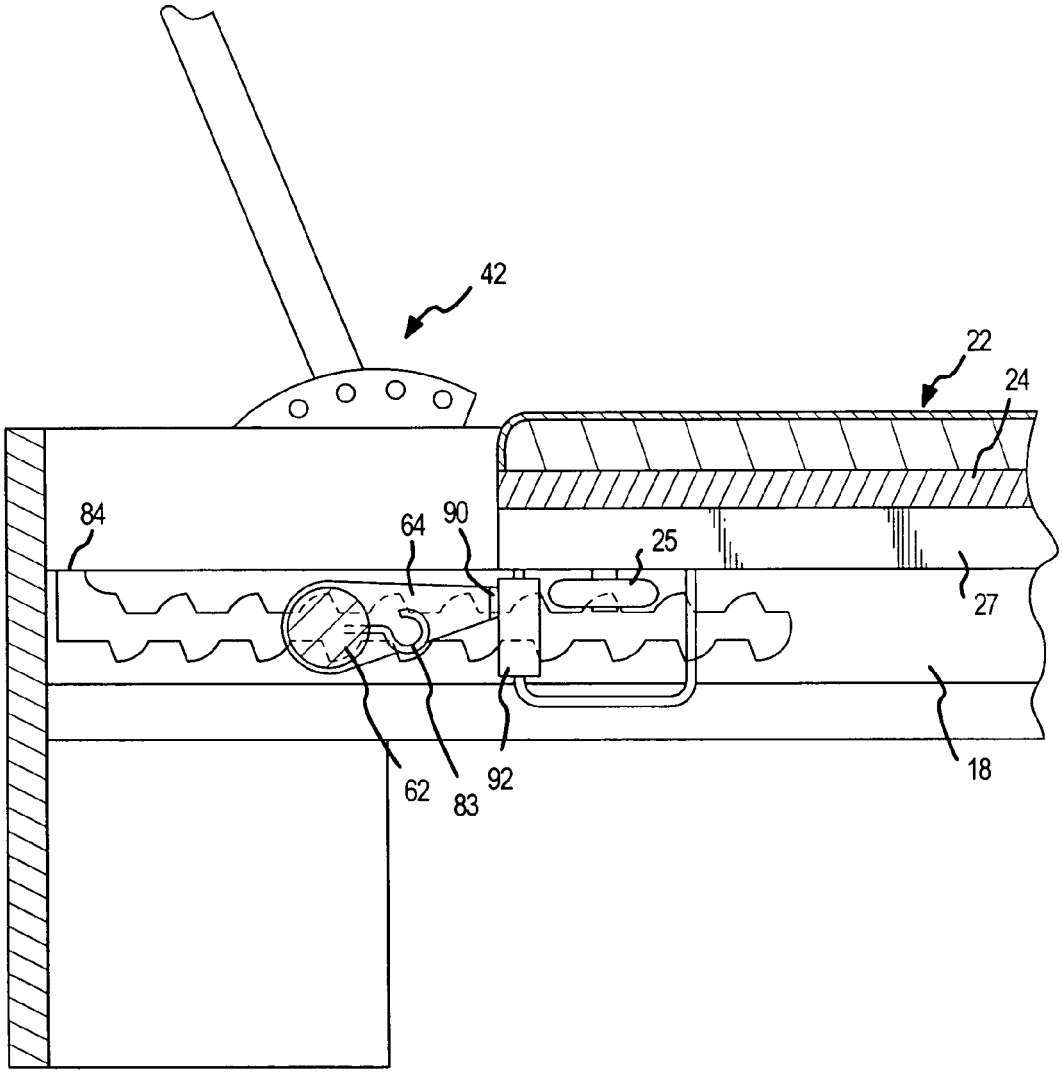
FIG. 5 is a sectional view taken along the line 5-5 in FIG. 2.

Operation of the assembly is best shown with reference to FIGS. 4 and 5. In FIG. 4, the foot end 16 of the apparatus 10 is shown with the anchor bar 62 positioned in both the locked position 86 and the unlocked position 88. The dashed lines 86 represent the anchor bar 62 in the locked position with the tenon 72 rotated so as to engage the teeth 68. In this position, note that the parallel sides of the tenon 72 are about 60 degrees from horizontal, thus preventing horizontal movement of the anchor bar 62.

The dotted lines 88 represent the anchor bar 62 in the unlocked position, in which the parallel sides of the tenons 72 are parallel to the longitudinal axis of the slot 66. In this rotational position, the anchor bar 62 is free to be moved from one lock portion to another lock portion. When the particular desired position is reached, the user can rotate the lock arms 64 clockwise to lock the anchor bar 62 in position and permit the carriage stop end 90 of the stop arms 64 to abut against a bumper 92 on the carriage 22 as is shown in FIG. 5. In this position, when at least one spring 30 is attached to one of the hooks 83, the anchor bar 62 is positively locked in position. In addition, even if no springs are attached, the anchor bar 62 is prevented from rotating upward or counterclockwise the offset mass of the assembly due to the elongated stop arms 64 projecting at right angles to the axis of rotation of the anchor bar 62.

Figure 9:
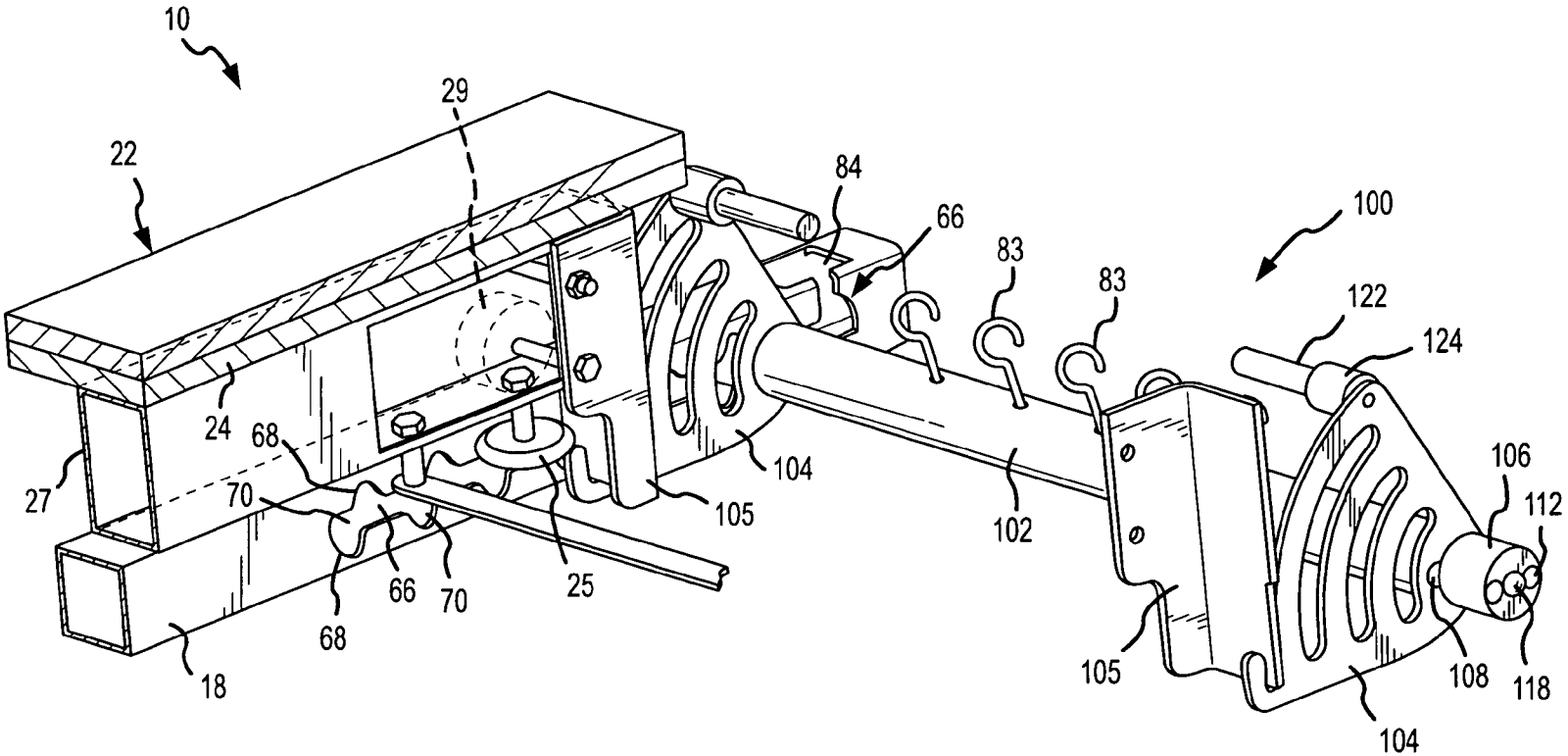
FIG. 9 is a separate perspective view of an anchor bar and carriage stop assembly in accordance with an alternative embodiment of the present invention with the anchor bar in an unlocked, engaged position with the carriage.
Figure 10:
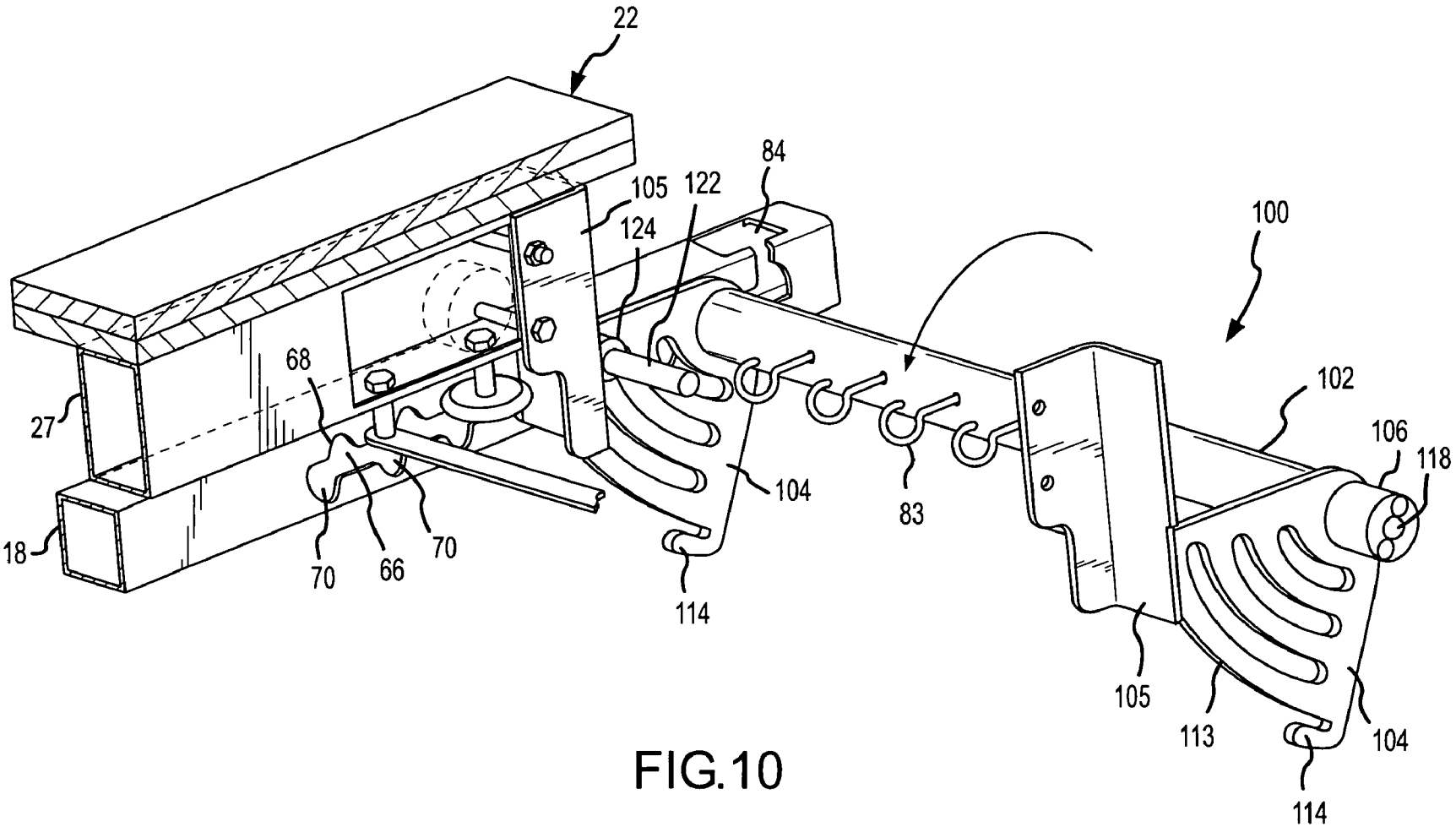
FIG. 10 is a separate perspective view of the anchor bar and carriage stop assembly shown in FIG. 9 with the anchor bar in the locked position and disengaged from the carriage.
Figure 11:
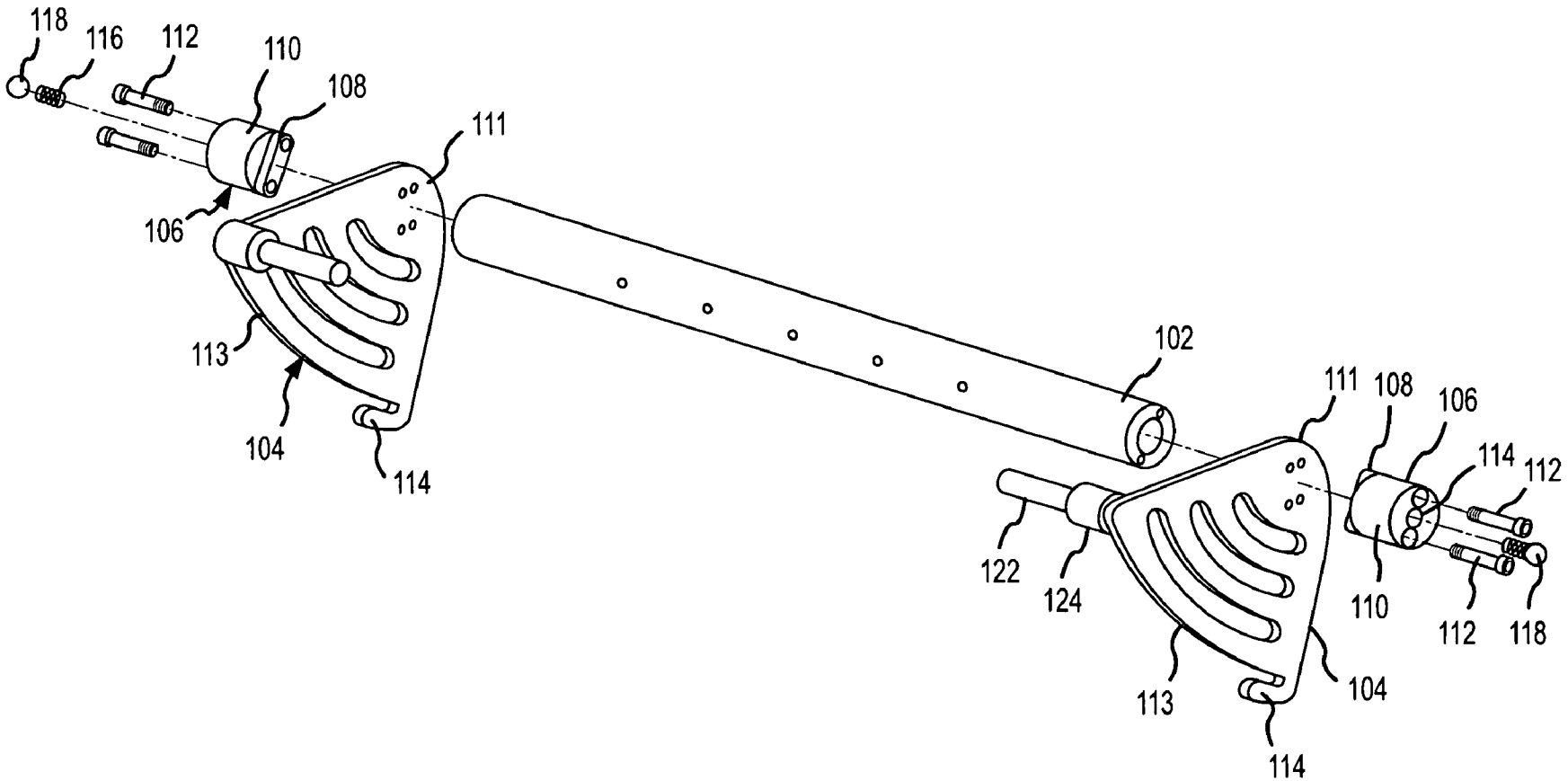
FIG. 11 is an exploded view of the anchor bar utilized in the anchor bar and carriage stop assembly shown in FIGS. 9 and 10.
Figure 12:
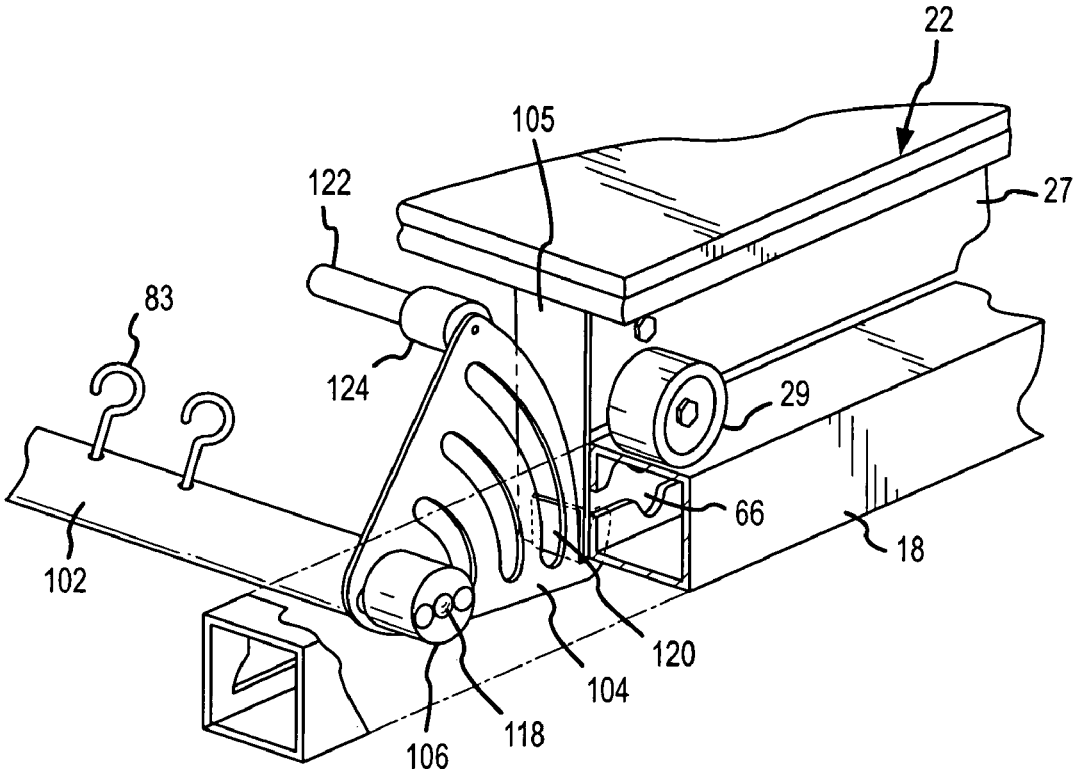
FIG. 12 is a foot end view of the anchor bar and carriage stop assembly shown in FIG. 9.

FIGS. 9 through 12 show a reformer 10 incorporating another preferred embodiment of an anchor bar and carriage stop assembly 100 in accordance with the present invention. In FIGS. 9, 10 and 12, only a foot end portion of the reformer 10, including one of the square tubular track members 18 and a corner portion of a carriage 22, similar to that shown in FIG. 5, are shown in perspective view to facilitate explanation of this embodiment 100.

Each of the track members 18 in the reformer apparatus 10 in accordance with this embodiment of the present invention is, again, a metal tube that has a rectangular, and preferably a generally square cross-sectional shape. These metal tubes are, in the embodiment illustrated, bolted or otherwise fastened to the inside surfaces of the side walls 20 of the frame 12. Alternatively, it is to be understood that the track members 18 may perform the support function of the side walls 20 in an all metal frame construction of the reformer, eliminating the need for separate side walls 20.

The carriage 22 again includes a generally flat padded platform 24 for supporting a user's body and has a pair of spaced apart shoulder stops 26 fastened to the upper surface of the platform 24 adjacent the head end of the carriage 22 and a head rest 28 centered between the shoulder stops 26. The head rest 28 may be hinged to the platform 24 such that it may be adjusted between at least a raised and a lowered position. The head rest 28 extends outward from the platform 24 toward the head end of the frame 12. Preferably the carriage 22 has four support wheels or rollers 29 as shown in dotted lines in FIGS. 9 and 10, and clearly shown in FIG. 12. These wheels 29 support the carriage 22 on the horizontal top surface of the track members 18 as shown in FIG. 12 for movement back and forth on the track members 18 with minimal friction. The carriage 22 also has 4 guide rollers 25 beneath the platform 24 adjacent the support rollers 29 that roll along the vertical inside surface of the track members 18 to prevent binding of the carriage 22 on the track members 18 or binding against the frame side walls 20. The guide and support roller 25 and 29 are each mounted to a square tubular member 27 fastened to and extending the length of the underside of the platform 24. A carriage stop angle bracket 105 is vertically fastened at the foot end of the carriage 22 to the foot end of each of the support tubular members 27. The lower end of this bracket 105 extends below the foot end of the tubular member 27 to which it is attached.

A plurality of elastic resistance members 30, typically springs as shown in the Figures (see FIGS. 2 and 8), are hooked to or otherwise fastened between the carriage 22 and the foot end 16 of the frame 12 such that the carriage 22 is biased toward the foot end 16 of the frame 12. These springs 30 are omitted from FIGS. 9-12 for clarity of the following description.

The springs 30 are removably attached to anchor hooks 83 on an anchor bar 102 forming part of the anchor bar and carriage stop assembly 100 incorporated with the tracks 18 at the foot end 16. The anchor bar and carriage stop assembly 100 adjustably anchors the springs 30 at the foot end 16 of the frame 12 and the assembly maintains a predetermined minimum distance between the carriage 22 and the anchor bar 102 via at least one carriage stop member 104 extending from the anchor bar 102 toward the carriage 22. In this preferred embodiment 100, there are two pie-piece shaped carriage stop members 104 that each engage one of the carriage stop brackets 105 and form part of the assembly 100. An alternative embodiment, not illustrated, may be constructed utilizing only a single carriage stop member 104. In such an embodiment, the stop member 104 would be positioned preferably adjacent the center spring 30 (see FIG. 8) and a single stop bracket similar to stop bracket 105 would preferably be fastened to the central underside of the carriage 22 to engage with the stop member 104.

The anchor bar 102 is separately shown in the exploded view of FIG. 11. This bar 102 is basically an elongated straight bar or tube that preferably has a circular cross section. Alternatively, bar 102 may have a square or D shaped cross section or other elongated closed, solid or internally open cross sectional shape. For example, bar 102 may be a tube have a thickened wall portion where the anchor hooks 83 are fastened into the bar 102.

Each end of the anchor bar 102 has a generally cylindrical cap 106 fastening one of the pie-piece shaped carriage stop members 104 thereto. The cap 106 has an elongated tenon portion 108 and a cylindrical body portion 110. The tenon portion 108 preferably has at least two parallel sides and may have rounded ends joining the parallel sides of the tenon portion 108. The tenon portion abuts axially against the carriage stop member 104 and spaces the cylindrical body portion 110 from the carriage stop member 104. The cap 106 is fastened to the anchor bar 102 via a pair of countersunk allen screws 112.

The cap 106 has a central axial recess or blind bore 114 that carries a spring-loaded indexing ball 118 at the open end thereof. More particularly, positioned in the bore 114 is a coil spring 116 that pushes against the ball 118 captured within the open end of the bore 114 and extending out of the cap 106. This ball 118 is designed to ride against the inner surface of the outer vertical wall of the square rail tube track member 18 and then snap into a detent or hole (not shown) in the outer wall of the track member 18 when aligned directly opposite one of the locking portions 70 in the slot 66 in the track member 18. This interaction gives a user a tactile feedback as to the correct longitudinal positioning of the anchor bar 102 in each of the locking portions 70.

The cylindrical body portion 110 of the cap 106 is preferably made of or coated with a low friction, tough polymer material such as nylon so as to easily slide within the track member 18 when the anchor bar 102 is installed between the track members 18. To install the anchor bar 102, the caps 106 are inserted into the openings 84 in the track members 18 so that the tenons 108 are positioned for longitudinal translation in the slots 66 in the track members 18.

The anchor bar 102 may alternatively be formed with the tenons 108 as integral part of the anchor bar 102. In this alternative, the cap 106 would each be a cylindrical body without the tenon. In this alternative, the stop member 104 would have an elongated slot to receive the tenon on the anchor bar 102.

The carriage stop member 104 is preferably a flat, pie-piece shaped sheet metal body that has a tapered proximal end 111 expanding to a larger arcuate distal end 113. The tapered proximal end 111 is fastened to the anchor bar 102. The edge of the arcuate distal end 113 follows an arc having a radius about the center of the anchor bar 102. The arcuate distal end 113 also has a latch finger 114 projecting from a bottom end of the arcuate portion of the distal end. This latch finger 114 is sized to engage with the lower end of the stop angle bracket 105 fastened to the tubular member 27 on the carriage 22 when the carriage 22 is retracted against the stop member 104 by the springs 30.

The carriage stop member 104 spaces carriage 22 from the anchor bar 102. When the anchor bar 102 is rotated upward by a user as is shown in FIGS. 9 and 12, the distal edge of the arcuate distal end 113 of the stop member 104 continues to abut against the bracket 105 such that the predetermined distance separating the carriage 22 from the anchor bar 102 is maintained. When the anchor bar 102 is rotated fully upward such that the sides of the tenons 108 are aligned parallel to the tracks 18 and thus parallel to the walls of the slots 66, the latch finger 114 has moved up, hooking behind the lower edge of the bracket 105, thus locking the carriage 22 and anchor bar 102 together. When this engaged position is reached, the anchor bar 102 is now unlocked, permitting the connected anchor bar 102, springs 30, and carriage 22 to be moved together along the tracks 18 with the caps 106 sliding within the tracks 18 along the slots 66. As the anchor bar 102 moves within the slots 66, the indexing balls 118 slide along the inside of the outer walls of the tracks 18. When a locking portion is encountered, the indexing balls drop into the recesses, indicating to the user that a locking portion has been reached. At this point, a user can then rotate the anchor bar 102 downward from the unlocked position, shown in FIG. 9, into the locked position as shown in FIG. 10. This action disengages the latch finger 114 from the carriage stop bracket 105 while still maintaining the minimum distance between the carriage 22 and the anchor bar 102.

A plastic cushion 120 is preferably mounted on the lower end of the stop bracket 105 to cushion the impact of the carriage 22 with the stop bracket 105 during operation of the exercise apparatus 10. This cushion 120 may cover just the lower end of the bracket 105, or may alternatively extend fully up the rear face of the bracket 105. In the preferred embodiment illustrated in FIGS. 9-12, each carriage stop member 104 has a handle 122 projecting laterally from the upper end of the arcuate portion.

This handle 122 may be a straight pin projecting from a rubber bumper sleeve 124, or may have any other shape, such as a ring for the user to grasp to rotate the anchor bar between the unlocked and locked positions. Alternatively, the handle 122 may located separate from the carriage stop member 104. The handle 122 may be located directly on and project upward from the anchor bar 102 itself, for example.

The present invention may be practiced otherwise than as specifically described above. Many changes, alternatives, variations, and equivalents to the various structures shown and described will be apparent to one skilled in the art. For example, each of the track members could have a "top hat" or U shaped cross section such that, when fastened to the inside of the sides of the frame, the track has a horizontal track surface for the carriage support rollers and a vertical side wall for the carriage guide rollers to ride against. The anchor bar and carriage stop assembly may be designed for use in a reformer apparatus as is disclosed in U.S. Pat. Nos. 5,607,381 and 5,338,278. In this instance, the tracks form tubular frame rails and the anchor bar slots would simply be formed in the tubular frame rails. The foot bar support assembly 42 would be mounted in T slots 54 fastened to the outside wall of the tubular frame rails so that the foot bar assembly 32 may be positioned anywhere along the length of the frame rails.

The anchor bar 62 may have a cross sectional shape other than circular as shown and may be solid or hollow. The stop arms 64 may have different shapes than a flat sheet metal shape as shown. These members may be round and may be alternately fashioned from a single piece of material. Similarly, the foot rest 32 and the foot rest support 38 may be made other than as specifically shown and described. The wheel 80 may be replaced with a sliding block arrangement in the tubular track member 18. Any such arrangement to keep the anchor bar tenon essentially centered in the slot 66 may be used. The anchor hooks 83 may be devices such as cap posts, hooks, rings, or other appropriately shaped members designed to receive or attach to one end of each of the springs 30. Alternatively, the anchor devices may be machined into the anchor bar 62.

The variations discussed above may also be incorporated with the alternative embodiment of the anchor bar and carriage stop assembly 100 shown in FIGS. 9-12. In addition, the shapes of the carriage stop bracket and stop members may be other than as specifically described and shown. For example, the caps 106 may incorporate rollers to facilitate smooth movement within the tracks 18.

Various other types of elastic resistance elements such as elastic cords may be substituted for springs 30. The carriage 22 may ride in a pair of horizontally oriented "U" shaped channel tracks, with the slots 66 and 54 integrally formed in the bottom wall portion of the extrusion of the track itself. A still further variation may include a pair of track members that each have an upper vertical wall, a middle horizontal wall, and a lower vertical wall, similar to a horizontally oriented "Z" shape cross-section with the keyway slots 66 formed in the lower wall. In this case, the carriage would roll along the middle wall and the upper wall would be fastened to the frame 12 of the reformer apparatus 10. In these alternatives, the anchor bar and carriage stop assembly 100 would also be incorporated.

Figure 13:
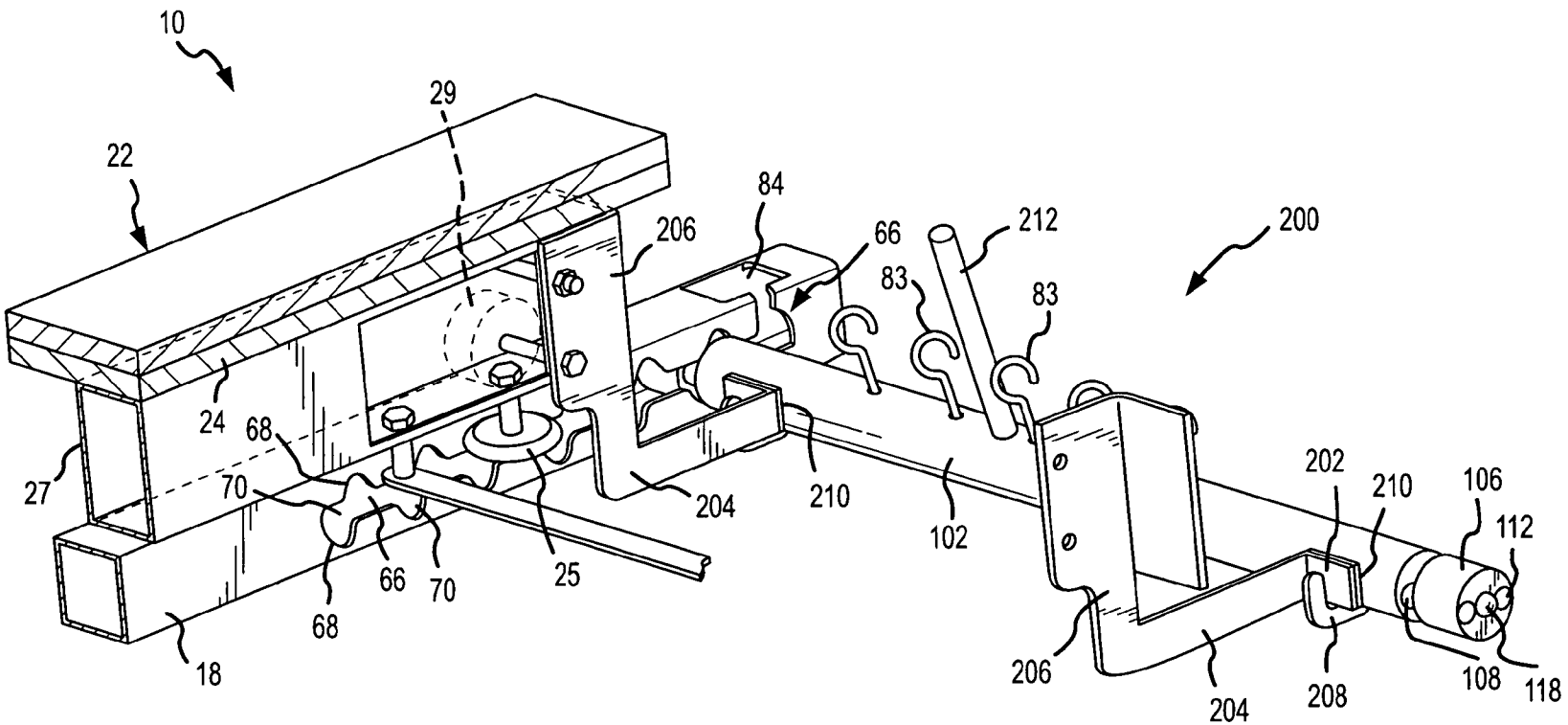
FIG. 13 is a separate perspective view of a further embodiment of the anchor bar and carriage stop assembly in accordance with the present invention with the anchor bar in an unlocked position.
Figure 14:
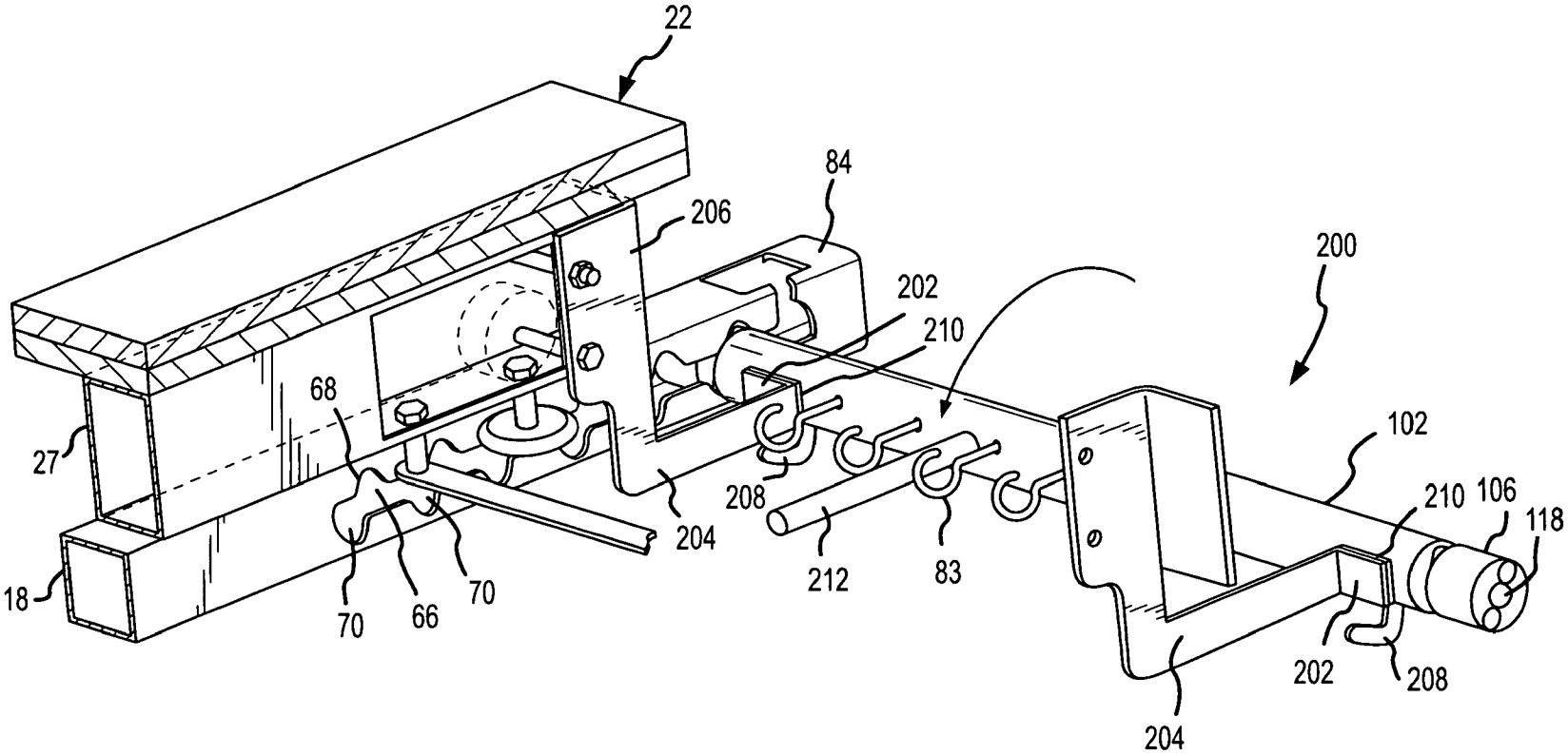
FIG. 14 is a separate perspective view as in FIG. 13 with the anchor bar in a locked position.

Another alternative embodiment 200 of the anchor bar and carriage stop assembly of the present invention may have the stop bracket/latch member and bracket 105 functions reversed. This alternative embodiment 200 is shown in FIGS. 13 and 14. In this embodiment 200, a free end 202 of an elongated bottom portion 204 of the metal angle stop bracket 206 extends toward and abuts against the anchor bar 102 when the springs 30 retract the carriage 22 toward the anchor bar 102. This stop bracket 206 may alternatively be replaced by a bracket 105 shown in FIGS. 9-12, on which a post may be fastened to the bottom portion thereof that projects toward the anchor bar 102 like bottom portion 204 does. In such an alternative, the stop members 104 would be omitted from the assembly and simply replaced by a latch hook 208 that would fit within a hole or recess in the end of the post. Again, contact between the anchor bar 102 and this bottom portion 204 or post, in the alternative case, maintains the predetermined distance between the anchor bar and the carriage.

The bottom portion 204 carries a cushion 210 at its distal end for contacting the anchor bar 102. A preferably central handle post 212 on the anchor bar 102 is grasped by the user to rotate the anchor bar 102 upward to the unlocked position, i.e., to position the tenons 108 parallel within the slots 66 as discussed above. In this embodiment 200, the handle post 212 may be other than a straignt rod. The combination of the bracket 206, the anchor bar 102, and the latch members 208 maintain the predetermined minimum distance between the carriage 22 and anchor bar 102 regardless of the position of the anchor bar 102 in the slots 66.

Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar.

2. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar and wherein the anchor bar has a generally upright oriented spacer plate having a center end portion fastened to the anchor bar and a curved end portion abutting the carriage.

3. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar and wherein the anchor bar has opposite ends and each end has a cylindrical end cap fastened thereto having an axially extending tenon fastened to the anchor bar end, and wherein each end cap is received in one of the elongated slots in one of the track members.

4. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar;

wherein the anchor bar has opposite ends and each end has a cylindrical end cap fastened thereto having an axially extending tenon fastened to the anchor bar end, and wherein each end cap is received in one of the elongated slots in one of the track members wherein the spacer plate includes a latch member on the curved end portion selectively engagable with the carriage to retain the anchor bar at the minimum distance to the carriage when the anchor bar is rotated to align the tenons in the elongated slots in the ends of the track members so that the anchor bar may be selectively moved between predetermined positions in the elongated slots in the parallel tracks.

5. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar and wherein the anchor bar has a generally upright oriented spacer plate having a center end portion fastened to the anchor bar and a curved end portion abutting the carriage wherein each slot in the track members has spaced anchor bar stop portions defining spaced anchor locked positions.

6. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame and wherein each slot in the track members has spaced anchor bar stop portions defining spaced anchor locked positions; and an elastic member anchor bar and carriage stop assembly adjustably anchoring the at least one elastic member to the anchor bar in a plurality of predetermined positions, wherein the anchor bar is selectively movable in the elongated slots between the anchor locked positions in the track members while maintaining a predetermined minimum distance between the carriage and the anchor bar and wherein the anchor bar has a generally upright oriented spacer plate having a center end portion fastened to the anchor bar and a curved end portion abutting the carriage wherein the anchor bar is operable to move between locked positions only when the anchor bar is rotated to an unlocked position.

7. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar, the anchor bar and carriage stop assembly comprising:

the anchor bar having opposite ends, each end having a cylindrical end cap fastened thereto via an axially extending tenon joining the anchor bar end, wherein each end cap is received in one of the elongated slots in one of the track members, and wherein the tenons each have parallel sides, the sides of each tenon being parallel to the slot in each track member only when the anchor bar is in an unlocked position; and a generally upright oriented spacer plate having a center end portion fastened to the anchor bar and a curved end portion abutting the carriage wherein the anchor bar is operable to move between locked positions only when the anchor bar is rotated to an unlocked position, wherein the spacer plate includes a latch member on the curved end portion selectively engagable with the carriage to retain the anchor bar at the minimum distance to the carriage when the anchor bar is rotated to align the tenons in the elongated slots in the ends of the track members so that the anchor bar may be selectively moved between predetermined positions in the elongated slots in the parallel tracks.

8. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in elongated slots in the track members near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar, the anchor bar and carriage stop assembly comprising:

the anchor bar having opposite ends, each end having a cylindrical end cap fastened thereto via an axially extending tenon joining the anchor bar end, wherein each end cap is received in one of the elongated slots in one of the track members, and wherein the tenons each have parallel sides, the sides of each tenon being parallel to the slot in each track member only when the anchor bar is in an unlocked position, and wherein the parallel sides of the tenons engage the anchor bar stop portions of the slots when the anchor bar is rotated to a locked position; and a generally upright oriented spacer plate having a center end portion fastened to the anchor bar and a curved end portion abutting the carriage wherein the anchor bar is operable to move between locked positions only when the anchor bar is rotated to an unlocked position, wherein the spacer plate includes a latch member on the curved end portion selectively engagable with the carriage to retain the anchor bar at the minimum distance to the carriage when the anchor bar is rotated to align the tenons in the elongated slots in the ends of the track members so that the anchor bar may be selectively moved between predetermined positions in the elongated slots in the parallel tracks.

9. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar, the assembly including a vertical oriented spacer plate extending from the anchor bar toward the carriage, the spacer plate having a latch member engagable with the carriage when the carriage is at the predetermined minimum distance from the anchor bar.

10. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame; and an elastic member anchor bar and carriage stop assembly adjustably anchoring the at least one elastic member to the anchor bar in a plurality of predetermined positions, the assembly including the anchor bar, the anchor bar having opposite ends and each end includes an axially extending tenon having parallel opposite sides, wherein the anchor bar is positionable at selectable predetermined positions along the elongated slots in the track members while maintaining a predetermined minimum distance between the carriage and the anchor bar, and a vertical oriented spacer plate extending from the anchor bar toward the carriage, the spacer plate having a latch member engagable with the carriage when the carriage is at the predetermined minimum distance from the anchor bar.

11. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame, wherein each slot has spaced anchor bar stop portions defining spaced locked positions; and an elastic member anchor bar and carriage stop assembly adjustably anchoring the at least one elastic member to the anchor bar in a plurality of predetermined positions, the assembly including the anchor bar, the anchor bar having opposite ends and each end includes an axially extending tenon having parallel opposite sides, wherein the anchor bar is positionable at the locked positions along the elongated slots in the track members while maintaining a predetermined minimum distance between the carriage and the anchor bar, and a vertical oriented spacer plate extending from the anchor bar toward the carriage, the spacer plate having a latch member engagable with the carriage when the carriage is at the predetermined minimum distance from the anchor bar.

12. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame, wherein each slot has spaced anchor bar stop portions defining spaced locked positions; and an elastic member anchor bar and carriage stop assembly adjustably anchoring the at least one elastic member to the anchor bar in a plurality of predetermined positions, the assembly including the anchor bar, the anchor bar having opposite ends and each end includes an axially extending tenon having parallel opposite sides, wherein the anchor bar is positionable at the locked positions along the elongated slots in the track members while maintaining a predetermined minimum distance between the carriage and the anchor bar, and a vertical oriented spacer plate extending from the anchor bar toward the carriage, the spacer plate having a latch member engagable with the carriage when the carriage is at the predetermined minimum distance from the anchor bar, wherein the anchor bar is operable to move between locked positions only when the anchor bar is rotated to an unlocked position.

13. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame, wherein each slot has spaced anchor bar stop portions defining spaced locked positions; and an elastic member anchor bar and carriage stop assembly adjustably anchoring the at least one elastic member to the anchor bar in a plurality of predetermined positions, the assembly including the anchor bar, the anchor bar having opposite ends and each end includes an axially extending tenon having parallel opposite sides, wherein the anchor bar is positionable at the locked positions along the elongated slots in the track members while maintaining a predetermined minimum distance between the carriage and the anchor bar, and a vertical oriented spacer plate extending from the anchor bar toward the carriage, the spacer plate having a latch member engagable with the carriage when the carriage is at the predetermined minimum distance from the anchor bar, wherein the anchor bar is operable to move between locked positions only when the anchor bar is rotated to an unlocked position, wherein the opposite sides of each tenon are parallel to the elongated slot in each track member and the latch member engages the carriage only when the anchor bar is in the unlocked position.

14. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame, wherein each slot has spaced anchor bar stop portions defining spaced locked positions; and an elastic member anchor bar and carriage stop assembly adjustably anchoring the at least one elastic member to the anchor bar in a plurality of predetermined positions, the assembly including the anchor bar, the anchor bar having opposite ends and each end includes an axially extending tenon having parallel opposite sides, wherein the anchor bar is positionable at the locked positions along the elongated slots in the track members while maintaining a predetermined minimum distance between the carriage and the anchor bar, and a vertical oriented spacer plate extending from the anchor bar toward the carriage, the spacer plate having a latch member engagable with the carriage when the carriage is at the predetermined minimum distance from the anchor bar, wherein the opposite sides of the tenons engage the anchor bar stop portions of the slots in the locked position.

15. An exercise apparatus comprising:

a frame having a head end and a foot end and including a pair of spaced apart parallel track members between the ends;

a movable carriage mounted on the frame for movement along the track members;

at least one elongated elastic member extending between the carriage and an anchor bar supported in the track members in elongated slots near the foot end of the frame; and an elastic member anchor bar and carriage stop assembly adjustably anchoring the at least one elastic member to the anchor bar in a plurality of predetermined positions, wherein the anchor bar is positionable at selectable predetermined positions along the elongated slots in the track members while maintaining a predetermined minimum distance between the carriage and the anchor bar, the assembly including a vertical oriented spacer plate having a pie-piece shape extending from the anchor bar toward the carriage, the spacer plate having a center end portion fastened to the anchor bar and a curved end facing the carriage, and a latch member engagable with the carriage when the carriage is at the predetermined minimum distance from the anchor bar.

16. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer member having one end fastened to one of the anchor bar and the carriage and an opposite end facing the other of the anchor bar and the carriage operable to maintain a minimum distance between the carriage and the anchor bar when the anchor bar is in an unlocked position.

17. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot;

a spacer member having one end fastened to one of the anchor bar and the carriage and an opposite end facing the other of the anchor bar and the carriage operable to maintain a minimum distance between the carriage and the anchor bar when the anchor bar is in an unlocked position; and a latch means for engaging the other of the anchor bar and the carriage when the anchor bar is in the unlocked position to maintain the minimum distance between the carriage and the anchor bar during movement of the anchor bar in the slots between anchor bar stop portions.

18. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot;

a spacer member having one end fastened to one of the anchor bar and the carriage and an opposite end facing the other of the anchor bar and the carriage operable to maintain a minimum distance between the carriage and the anchor bar when the anchor bar is in an unlocked position; and a latch means for engaging the other of the anchor bar and the carriage when the anchor bar is in the unlocked position to maintain the minimum distance between the carriage and the anchor bar during movement of the anchor bar in the slots between anchor bar stop portions, wherein each end of the anchor bar has an axially extending tenon having parallel sides.

19. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot;

a spacer member having one end fastened to one of the anchor bar and the carriage and an opposite end facing the other of the anchor bar and the carriage operable to maintain a minimum distance between the carriage and the anchor bar when the anchor bar is in an unlocked position; and a latch means for engaging the other of the anchor bar and the carriage when the anchor bar is in the unlocked position to maintain the minimum distance between the carriage and the anchor bar during movement of the anchor bar in the slots between anchor bar stop portions;

wherein each end of the anchor bar has an axially extending tenon having parallel sides wherein the parallel sides of the tenon engage the anchor bar stop portions when the anchor bar is in a locked position.

20. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot;

a spacer member having one end fastened to one of the anchor bar and the carriage and an opposite end facing the other of the anchor bar and the carriage operable to maintain a minimum distance between the carriage and the anchor bar when the anchor bar is in an unlocked position, and;

a means on the anchor bar for determining when the anchor bar is at one of the stop portions.

21. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot;

a spacer member having one end fastened to one of the anchor bar and the carriage and an opposite end facing the other of the anchor bar and the carriage operable to maintain a minimum distance between the carriage and the anchor bar when the anchor bar is in an unlocked position; and a spring loaded ball projecting from each end of the anchor bar that is engagable with a recess in the tubular track at each stop portion for determining when the anchor bar is at one of the stop portions.

22. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer member having one end fastened to one of the anchor bar and the carriage and an opposite end facing the other of the anchor bar and the carriage operable to maintain a minimum distance between the carriage and the anchor bar when the anchor bar is in an unlocked position, wherein the spacer member is a generally upright oriented spacer plate having a center end portion fastened to the anchor bar and a curved end portion abutting the carriage.

23. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer member having one end fastened to one of the anchor bar and the carriage and an opposite end facing the other of the anchor bar and the carriage operable to maintain a minimum distance between the carriage and the anchor bar when the anchor bar is in an unlocked position, wherein the spacer member is a generally upright oriented spacer plate having a center end portion fastened to the anchor bar and a curved end portion abutting the carriage and wherein the anchor bar has opposite ends and each end has a cylindrical end cap fastened thereto having an axially extending tenon fastened to the anchor bar end, and wherein each end cap is received in one of the elongated slots in one of the track members.

24. An anchor bar and carriage stop assembly for use in an exercise apparatus having a movable carriage mounted on parallel track members, the assembly comprising:

each the track member having an elongated tubular shape and a longitudinal axis, each track member having an elongated slot parallel to the longitudinal axis of the track member;

an anchor bar having opposite ends, each end having a cylindrical end cap fastened thereto having an axially extending tenon fastened to the anchor bar end, each end extending into the elongated slot in one of the track members and wherein each end cap is received in one of the elongated slots in one of the track members, wherein each track member has a plurality of spaced anchor bar stop portions formed in the slot engagable with the end of the anchor bar when the anchor bar is in a locked position in the slot to prevent end movement along the slot; and a spacer member having one end fastened to one of the anchor bar and the carriage and an opposite end facing the other of the anchor bar and the carriage operable to maintain a minimum distance between the carriage and the anchor bar when the anchor bar is in an unlocked position, wherein the spacer member is a generally upright oriented spacer plate having a center end portion fastened to the anchor bar and a curved end portion abutting the carriage and has a latch member on the curved end portion selectively engagable with the carriage to retain the anchor bar at the minimum distance to the carriage when the anchor bar is rotated to align the tenons in the elongated slots in the ends of the track members so that the anchor bar may be selectively moved between predetermined positions in the elongated slots in the parallel tracks.

25. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position.

26. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a vertically oriented spacer means having one end fastened to the anchor bar and an opposite end facing the carriage for maintaining a predetermined distance between the carriage and the anchor bar when the anchor bar is in an unlocked position and maintaining a minimum distance between the carriage and the anchor bar when the anchor bar is in a locked position.

27. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a vertically oriented spacer member having one end fastened to the anchor bar and an opposite end facing the carriage for maintaining a predetermined distance between the carriage and the anchor bar when the anchor bar is in an unlocked position and maintaining a minimum distance between the carriage and the anchor bar when the anchor bar is in a locked position wherein the vertically oriented member has a latch means extending therefrom for engaging with the carriage to maintain the predetermined distance in the unlocked position.

28. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein each end of the anchor bar carries a spring loaded ball in an axial blind bore positioned to removably engage a portion of the track member at each locked portion to indicate registration of the anchor bar at each of the locked positions.

29. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein each end of the anchor bar includes a generally cylindrical cap having a tenon connected to the anchor bar and wherein the tenon is sized to slide within the slot in the track member and the cylindrical cap substantially centers the tenon inside the track member.

30. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position wherein the spacer means includes a pair of vertically oriented members each having one end attached to the anchor bar.

31. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position wherein the spacer means includes a pair of vertically oriented members each having one end attached to the anchor bar wherein the vertically oriented members each has a latch member for engaging the carriage when the anchor bar is in the unlocked position.

32. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein the spacer means is a bracket fastened to the carriage, wherein the bracket has an elongated member extending from the carriage toward the anchor bar to abut against the anchor bar in the unlocked position and in the locked position.

33. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein the spacer means is a bracket fastened to the carriage, wherein the bracket has an elongated member extending from the carriage toward the anchor bar to abut against the anchor bar in the unlocked position and in the locked position, wherein a distal end of the elongated member carries a cushioning pad to absorb impact between the carriage and the anchor bar.

34. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein the spacer means is a bracket fastened to the carriage, wherein the bracket has an elongated member extending from the carriage toward the anchor bar to abut against the anchor bar in the unlocked position and in the locked position, wherein the anchor bar has a latch member extending therefrom engagable with the elongated member extending from the carriage when the anchor bar is in the unlocked position.

35. An anchor bar and carriage stop assembly for use in an exercise apparatus having a movable carriage mounted on parallel track members, the assembly comprising:

each the track member having an elongated tubular shape and a longitudinal axis, each track member having an elongated slot therein extending parallel to the longitudinal axis of the track member;

an anchor bar having opposite ends, each end extending into the elongated slot in one of the track members, wherein each track member has a plurality of spaced anchor bar stop portions formed in the slot engagable with the end of the anchor bar when the anchor bar is in a locked position in the slot to prevent end movement along the slot; and a spacer means having one end fastened to one of the anchor bar and the carriage and an opposite end facing the other of the anchor bar and the carriage for maintaining a predetermined distance between the carriage and the anchor bar when the anchor bar is in an unlocked position and maintaining a minimum distance between the carriage and the anchor bar when the anchor bar is in a locked position, wherein the spacer means includes a pair of brackets each fastened to a support tube on the carriage, wherein each bracket has an elongated portion extending from the carriage toward the anchor bar to abut against the anchor bar in both the unlocked and locked positions.

* * * * *